US008371369B2

(12) United States Patent
Clem et al.

(10) Patent No.: US 8,371,369 B2
(45) Date of Patent: Feb. 12, 2013

(54) CROSSOVER SUB WITH EROSION RESISTANT INSERTS

(75) Inventors: Nicholas J. Clem, Houston, TX (US); Martin P. Coronado, Cypress, TX (US); Steve Rosenblatt, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 215 days.

(21) Appl. No.: 12/250,065

(22) Filed: Oct. 13, 2008

(65) Prior Publication Data

US 2009/0255667 A1 Oct. 15, 2009

Related U.S. Application Data

(63) Continuation-in-part of application No. 11/999,374, filed on Dec. 4, 2007, now Pat. No. 7,762,324.

(51) Int. Cl.
*E21B 43/04* (2006.01)
*E21B 43/08* (2006.01)

(52) U.S. Cl. ..... 166/51; 166/222; 166/278

(58) Field of Classification Search ..... 166/278, 166/308.1, 51, 177.5, 222, 223, 242.4
See application file for complete search history.

(56) References Cited

U.S. PATENT DOCUMENTS

| | | | | |
|---|---|---|---|---|
| 3,145,776 | A * | 8/1964 | Pittman | 166/55 |
| 4,782,896 | A | 11/1988 | Witten | |
| 5,577,559 | A | 11/1996 | Voll et al. | |
| 5,597,040 | A | 1/1997 | Stout et al. | |
| 5,636,691 | A | 6/1997 | Hendrickson et al. | |
| 5,829,539 | A | 11/1998 | Newton et al. | |
| 6,155,342 | A * | 12/2000 | Oneal et al. | 166/51 |
| 6,227,303 | B1 * | 5/2001 | Jones | 166/378 |
| 6,491,097 | B1 | 12/2002 | Oneal et al. | |
| 6,973,974 | B2 | 12/2005 | McLoughlin et al. | |
| 7,096,946 | B2 | 8/2006 | Jasser et al. | |
| 7,373,989 | B2 | 5/2008 | Setterberg, Jr. | |
| 7,503,384 | B2 | 3/2009 | Coronado | |
| 7,559,357 | B2 | 7/2009 | Clem | |
| 7,841,396 | B2 * | 11/2010 | Surjaatmadja | 166/177.5 |
| 2002/0108752 | A1 * | 8/2002 | Morey et al. | 166/222 |
| 2006/0022073 | A1 * | 2/2006 | King et al. | 239/590 |
| 2006/0151174 | A1 | 7/2006 | Cantin et al. | |
| 2007/0062686 | A1 * | 3/2007 | Rouse et al. | 166/51 |
| 2008/0314588 | A1 * | 12/2008 | Langlais et al. | 166/278 |

FOREIGN PATENT DOCUMENTS

EP 0935050 A2 8/1999

OTHER PUBLICATIONS

Pedroso, C.A., et al., "Lighweight Proppants: Solution for Gravel Packing Horizontal Wells Under Extreme Conditions", SPE 98298; Feb. 2006; 1-12.

Porter, D.A., et al., "Designing and Completing High-Rate Oil Producers in a Deepwater Unconsolidated Sand", SPE 58735; Feb. 2000; 1-19.

(Continued)

*Primary Examiner* — Brad Harcourt
(74) *Attorney, Agent, or Firm* — Steve Rosenblatt

(57) ABSTRACT

A crossover tool that resists the erosive forces of high velocity slurry streams of gravel in downhole fracturing and gravel packing operations employs hardened inserts that protect the inside face of the housing as well as the openings through the crossover housing wall. The inserts have an extending portion that goes through housing openings preferably to the outer surface of the housing. The inserts also have inboard flanged surfaces that preferably abut or overlap to give preferably full inner wall protection to the housing from the flow of abrasive slurry. The inserts can be secured to each other or to the interior of the housing to hold them firmly in place.

21 Claims, 4 Drawing Sheets

OTHER PUBLICATIONS

Ross, Colby M., "New Tool Designs for High Rate Gravel Pack Operations", SPE 29276; Mar. 1995; 227-234.

Hill, Leo E, "Completion Tools Proven Successful in Deepwater Frac Packs and Horizontal Gravel Packing", IADC/SPE 74492; Feb. 2002, 1-15.

Mendez, A, et al., "A Quantum Leap in Horizontal Gravel Pack Technology", SPE 94945; Jun. 2005; 1-7.

Burton, R.C., et al., Innovative Completion Design and Well Performance Evaluation for Effective Frac-Packing of Long Intervals: A Case Study from the West Natuna Sea, Indonesia, SPE 74351; Feb. 2002; 1-24.

* cited by examiner

CROSSOVER SUB WITH EROSION RESISTANT INSERTS

PRIORITY INFORMATION

This application is a continuation-in-part of U.S. patent application Ser. No. 11/999,374, filed on Dec. 4, 2007.

FIELD OF THE INVENTION

The field of the invention relates to downhole tools that deliver abrasive slurries into a surrounding annulus in the tool and/or into an annular space in the well surrounding the tool and more particularly design features that minimize the erosive effects of slurry passing through openings in the tool.

BACKGROUND OF THE INVENTION

Certain completions use screens and fill the annular space around the screens with particles known as proppant as an aid to controlling production of sand or other particulates from the formation and fracturing the formation. The proppant is prepared at the surface as a slurry and pumped downhole into a bottom hole assembly that extends through an isolation packer to the zone of interest. The bottom hole assembly has a series of screens. Inside the screens is a tool called a crossover that allows the slurry pumped down from the surface to get through the packer and then exit into an annular space below the packer and outside the screens. The gravel remains in the annular space outside the screens and the carrier fluid for the slurry enters a wash pipe inside the screen and goes into different porting in the crossover tool to get to the upper annulus above the set packer for the return trip back to the surface.

While proppant slurry is abrasive, its erosive effects are also directly related to its velocity which is also related to the pumped pressure. When delivery rates were lower, such as with gravel packing at lower flow rates and pressures, the erosion problem was present but manageable. More recently, the need for higher delivery rates and higher operating pressures such as when proppant delivery was also combined with formation fracturing has made the erosion problem more acute. The evolution to higher flow rates and operating pressures has also caused erosion to an outer tubular that extended around the crossover exit ports and which supported the screens below. The slurry had to impact this tubular before making an exit to the annular space around the screens. To protect this outer tubular from direct impingement from the high flow and high pressure slurry, abrasive resistant liners were placed inside made of a hardened material to extend the operating life of the assembly.

One response to the erosion problem, which is generally more severe at the location where the slurry is forced to change direction, has been to use inserts that are hardened and which are positioned literally in the ports where the slurry has to exit. This design is shown in U.S. Pat. No. 6,491,097 FIGS. 4A-4E. This approach was offered as an alternative to an earlier design that used a hardened ported sleeve inside the crossover with the sleeve ports aligned with ports in the crossover housing but having a smaller periphery so as to protect the edges of the crossover body ports from erosion by flowing slurry. This design is shown in U.S. Pat. No. 5,636,691. Other downhole valve designs have used inserts in ported sleeves that are shifted into and out of alignment with ports in a surrounding housing. One such design is shown in FIG. 4 of U.S. Pat. No. 6,973,974. Other designs of crossovers have attempted to reduce erosion after the exiting flow goes through the crossover ports and into an annulus defined by an outer tubular by reducing the energy of the flowing stream in that annular space by placing a hardened rotating member that is turned by the slurry stream as shown in U.S. Pat. No. 7,096,946. Protective sleeves at an inlet to a crossover have been used as shown in U.S. Pat. No. 5,597,040.

One of the issues with using an internal hardened sleeve is that it left the actual ports in the crossover housing unprotected in the portion of those ports that extended through the crossover wall. While an internal sleeve protected the crossover housing port interior edge at the inside housing wall, once the slurry got into the housing wall, the peripheral surface of the port through the wall and at the outer surface of the housing wall was left unprotected and suffered from erosion. That early design shown in U.S. Pat. No. 5,636,691 had these issues. The later design that put the inserts into the wall such as U.S. Pat. No. 6,491,097 protected the inside of the housing wall as the slurry passed through it but it had other disadvantages. The older internal sleeve design protected the inside surface of the crossover housing and going to just inserts in the ports through the wall of the crossover housing left the entire inside surface of the crossover housing exposed to erosive flow. Not only that but since the inserts were at most just flush with the internal housing wall at the housing ports and the interior housing wall was exposed, it left open an erosion path to start by removal of the interior housing wall around the periphery of the insert that was only in the wall. This opens a possibility of starting a bypass stream on the outside of the wall insert as the surrounding wall was eroded away. In severe cases the housing port could be enlarged enough to undermine the support for the insert.

The present invention seeks to overcome these shortcomings of the prior design by allowing an insert assembly to be employed that protects the passage through the housing wall where the slurry exits through ports and also affords interior wall protection to the housing inside wall and inside edges of the wall ports in the housing. A series of erosion resistant inserts are inserted into wall openings. The inserts include a segment that extends through the wall opening and an interior flange that straddles the wall opening on the inside surface and in the preferred embodiment covers the inside wall from erosive effects. The inserts can be configured to keep each other in position or they can be secured to the housing or to each other. Edges of the inserts can be made to overlap inside the crossover housing to hold them in place or to better secure the interior housing wall from erosion from slurry that might otherwise work a path to the inside housing wall between abutting inserts. These and other features of the present invention will become more clear to those skilled in the art from a review of the discussion of the preferred embodiment and the associated drawings while recognizing that the full scope of the invention is determined from the associated claims.

SUMMARY OF THE INVENTION

A crossover tool that resists the erosive forces of high velocity slurry streams of gravel in downhole fracturing and gravel packing operations employs erosion resistant inserts that protect the inside face of the housing as well as the openings through the crossover housing wall. The inserts have an extending portion that goes through housing openings preferably to the outer surface of the housing. The inserts also have inboard flanged surfaces that preferably abut or overlap to give preferably full inner wall protection to the housing from the flow of abrasive slurry. The inserts can be secured to each other or to the interior of the housing to hold them firmly in place.

DETAILED DESCRIPTION OF THE PREFERRED EMBODIMENT

Figure 1:
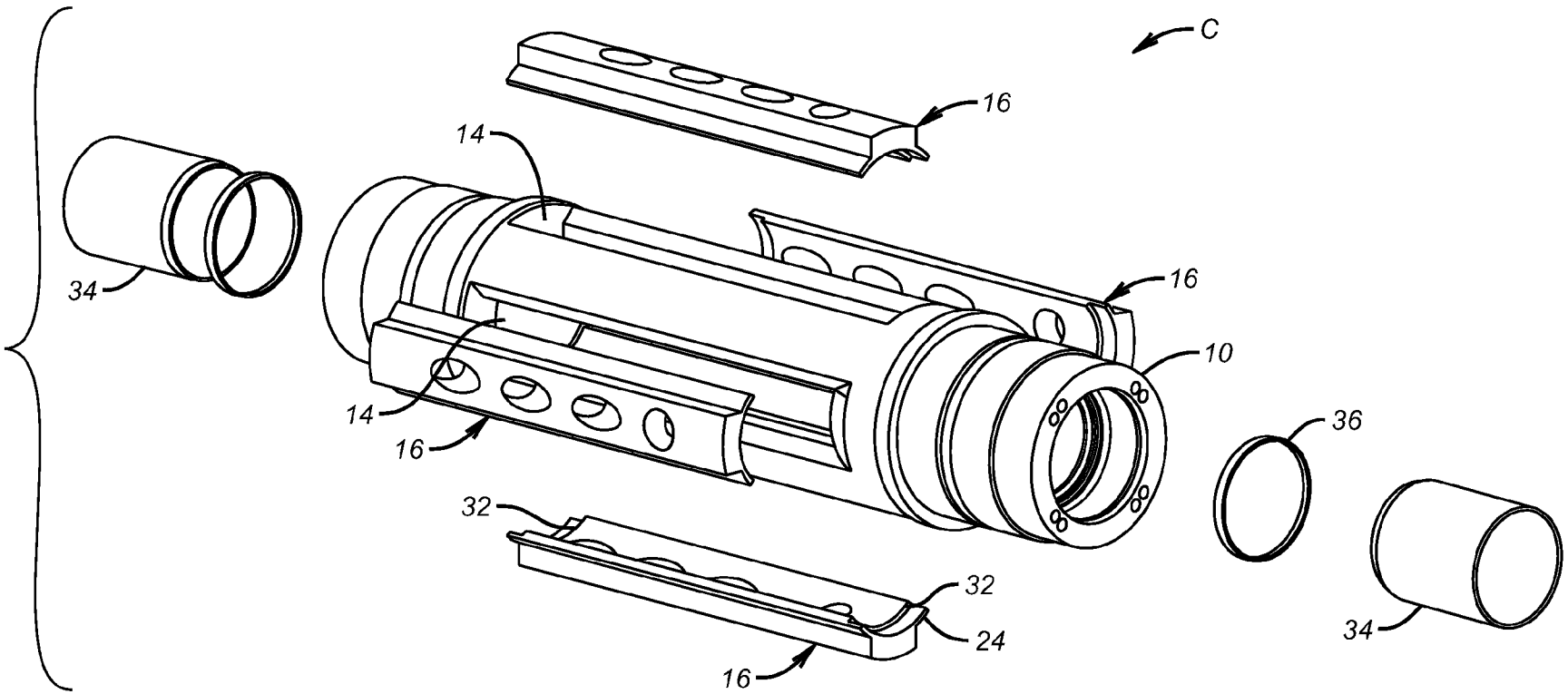
FIG. 1 is an exploded view of the crossover housing with 4 inserts.
Figure 2:
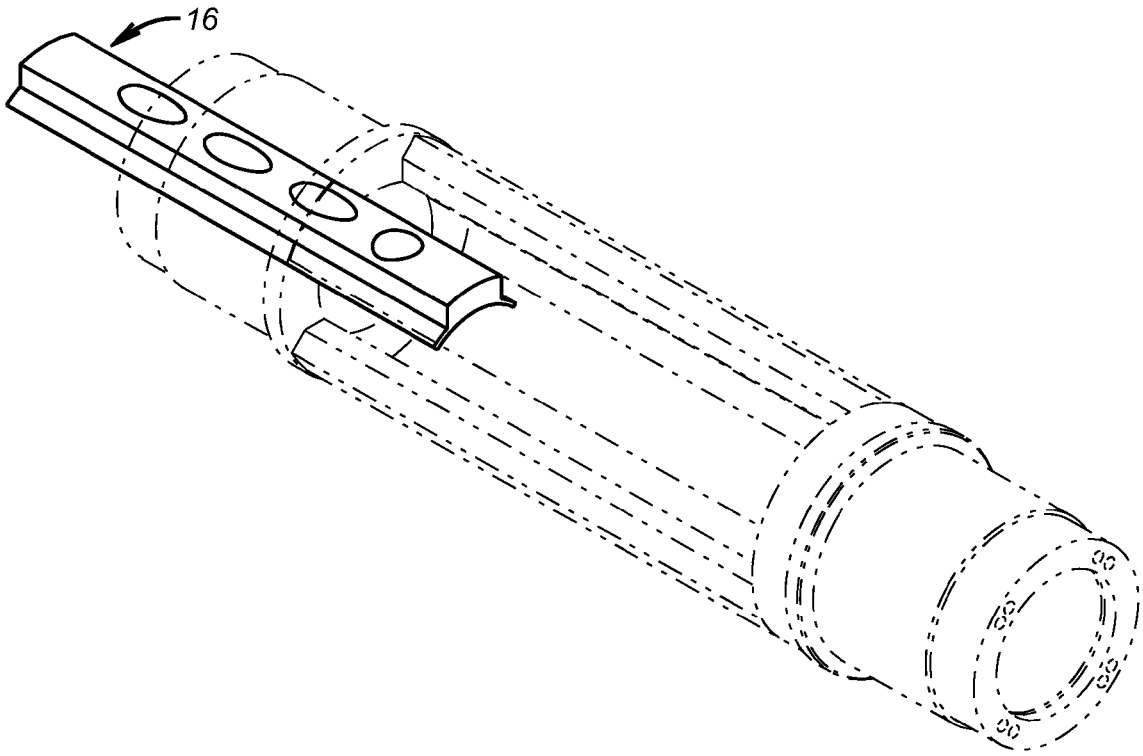
FIG. 2 shows an insert moved into the housing in the assembly process.
Figure 3:
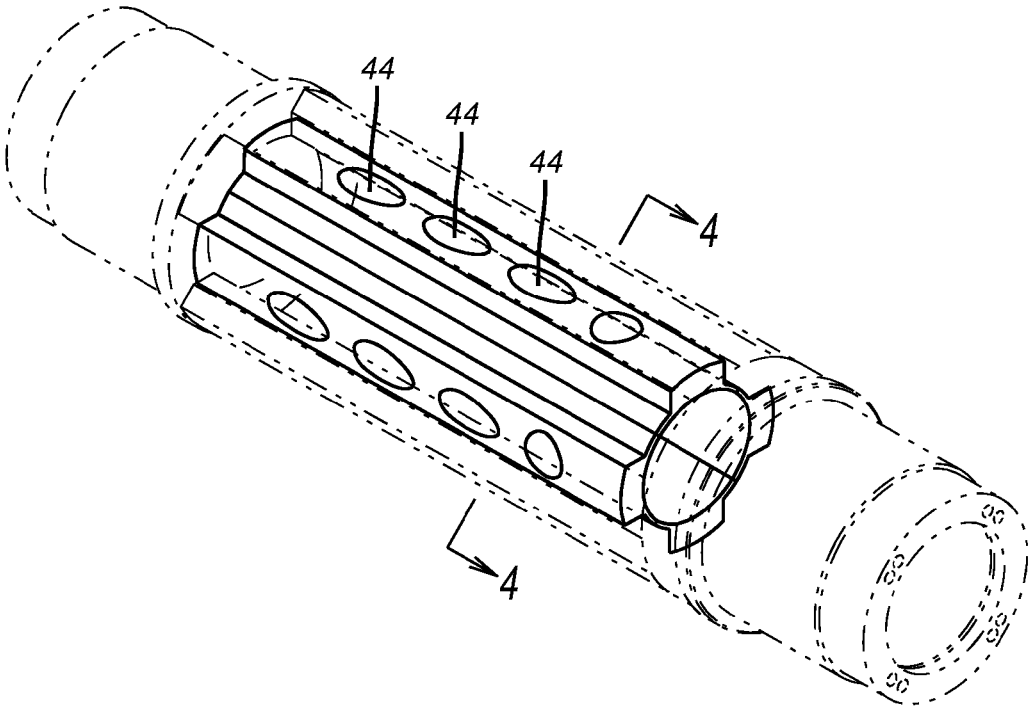
FIG. 3 is the view of FIG. 2 with all inserts assembled.
Figure 4:
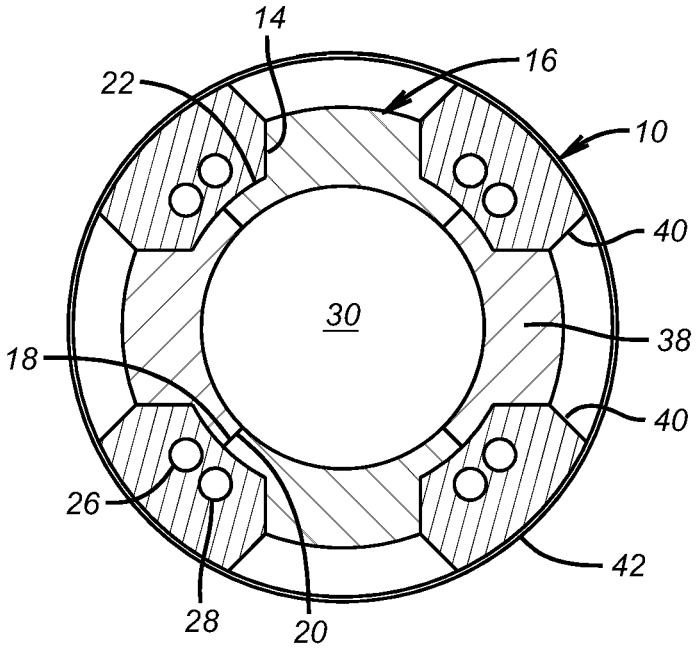
FIG. 4 is the view along lines 4-4 of FIG. 3.
Figure 7:
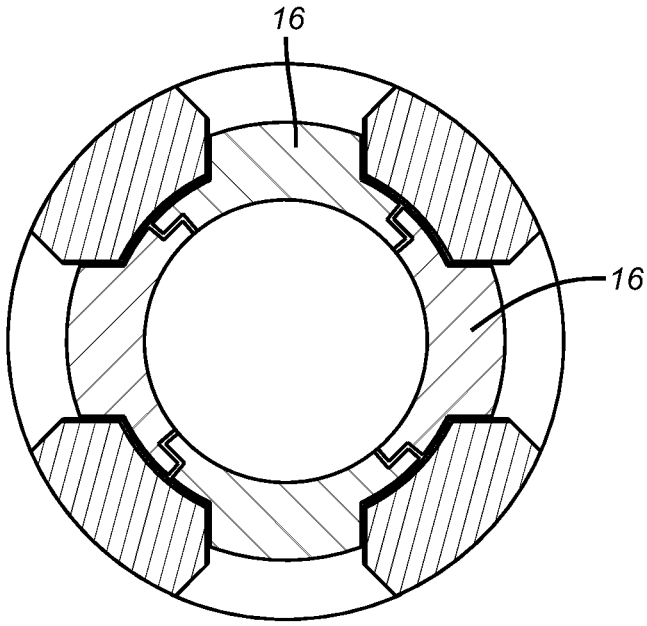
FIG. 7 is an alternative edge detail for the inserts than shown in FIG. 4.
Figure 5:
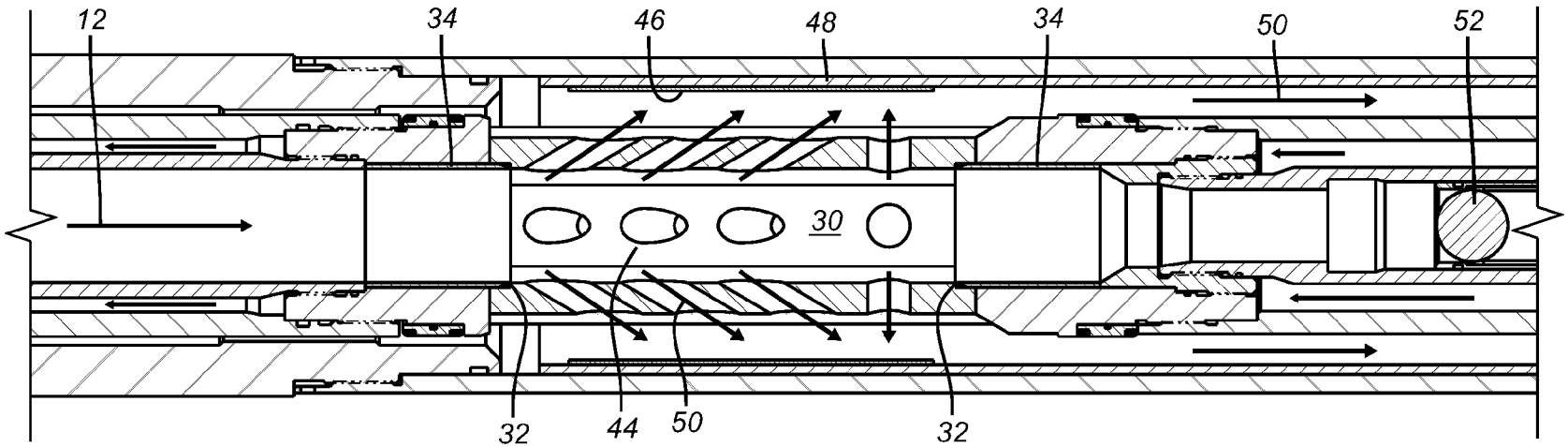
FIG. 5 is a section through the assembled crossover showing the outer tube.
Figure 6:
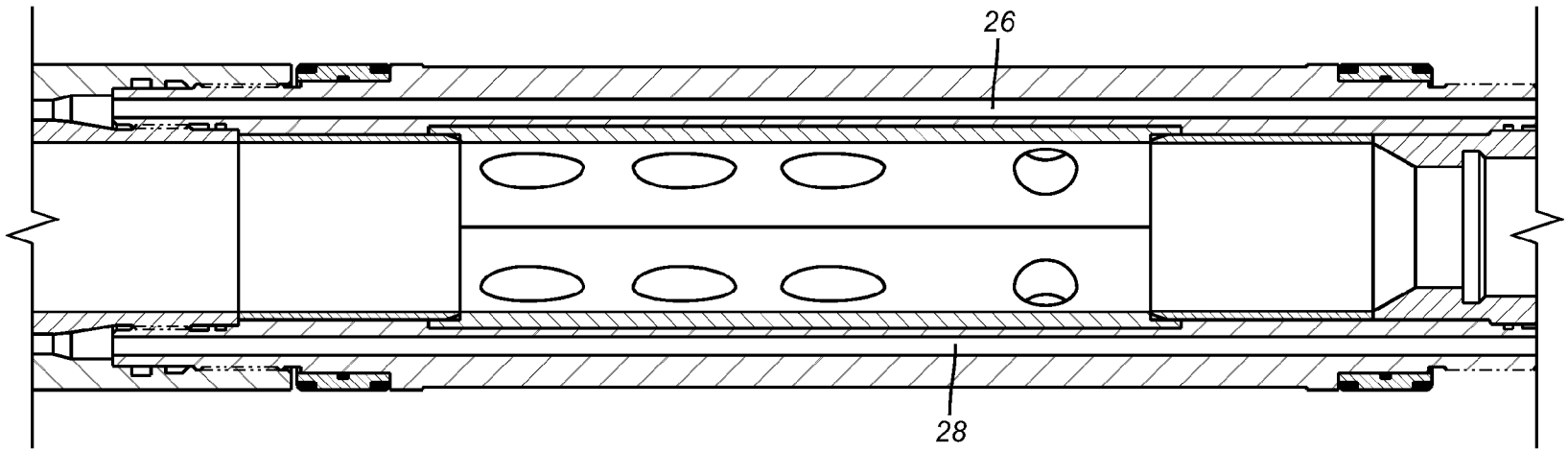
FIG. 6 is another section and rotated from FIG. 5 showing the return flow paths back into the crossover and into the packer above.

FIG. 1 shows the housing 10 for the crossover assembly C that is shown more fully in FIGS. 5 and 6. Arrow 12 in FIG. 5 illustrates the inlet slurry flow into the housing 10. In FIG. 1, by way of example, there are 4 outlets 14 in the housing 10 only two of which a visible. The four inserts 16 are shown in FIG. 1. Each insert 16 is preferably identical and is made to be inserted into a corresponding outlet 14 from within the housing 10. The preferred material is tungsten carbide or some other material more erosion resistant than the body 10. FIG. 2 illustrates the first insert 16 being advanced into the housing 10 on its way to an opening 14. In FIG. 3 all four inserts 16 have been advanced into position in housing 10 and are ready to be secured in that position. FIG. 4 is a section through the housing 10 showing the inserts 16 in position and abutting within the housing 10 while portions extend into the openings 14. FIG. 4 shows that the longitudinal edges 18 and 20 of each of the adjacent inserts 16 are abutting. Preferably the abutting edges are under a compressive force as a result of assembly to help hold their position within housing 10. Preferably, the entire inside wall 22 of the housing 10 is covered by the curved portions 24 seen in FIG. 1. While the edges 18 and 20 are shown only abutting on a single plane in FIG. 4 regardless of plane orientation, they can also overlap while abutting as shown in FIG. 7 to better insulate the return passages 26 and 28 that are shown in transverse section in FIG. 4 and in longitudinal section in FIG. 6. If slurry creates erosion in inlet passage 30 that gets between the abutting edges 18 and 20 and opens a path to passages 26 and 28 then the tool is compromised. While abutting edges 18 and 20 should prevent this from happening as an alternative the edges that abut can be in a step pattern so that there is overlapping hardened material at each seam formed between two inserts to give additional assurance that the butt joints will not be compromised to slurry flow.

Each insert can be secured within housing 10 by welding or some other form of permanent attachment or a removable method of securing the inserts 16 can be devised. In the FIG. 1 embodiment, each insert has a ledge 32 at opposed ends such that when the retaining sleeves 34 are inserted at opposed ends with a seal ring 36 preferably made of Teflon, the inserts are held in place as better seen in FIG. 5. In this manner the inserts 16 can be removed and replaced after use. As a practical matter, operators will rarely want the crossover housing 10 reused after a job due to uncertainties about the effects of erosion and the high cost of replacing the crossover in the middle of a gravel pack or fracturing job. For that reason, permanently attaching the inserts 16 is a simple and a lower cost alternative to the removable design shown in FIGS. 1 and 5. One way to do this is to fixedly mount the retaining sleeves 34 by welding or brazing them to the housing 10 as a simpler way than trying to fixate the inserts 16 directly.

Turning back to FIG. 1 and FIG. 4 it can be seen that inserts 16 have a leading component 38 that extends into a respective opening 14. The opening 14 flares at 40 outwardly to the outer surface 42 of the housing 10. As shown in FIG. 4 the leading component 38 ends at the start of the taper or flare 40 for a given opening 14. Those skilled in the art will appreciate that the flares 40 are optional and the length of the component 38 can be varied so that it extends radially out to outer surface 42. The leading component 38 has the shape of the opening 14 so that installation from within housing 10 is made simple. As an alternative to the layout of FIG. 4 the component 38 can extend to outer surface 42 while having the same shape as the opening 14 so that slurry flow represented by arrow 12 in FIG. 5 will be isolated from the inside wall 22 and then pass through openings 44 in each insert 16 and against hardened shield 46 that is inside outer tubular 48 as indicated by arrows 50 before exiting to the annulus outside the screens (not shown). In the known manner, seated ball 52 blocks slurry access to the screens and sends the incoming flow out the openings 44 as indicated by arrows 50. Openings 44 are slanted down and radially outwardly and in a plane that goes through the central axis as indicated by the slanted arrows 50 in FIG. 5. One or more holes further downhole can exit radially so that the exiting flow streams intersect and the velocity and the erosive effects are reduced against shield 46 as best seen in FIG. 5. The holes 44 are preferably the same size in area. Those skilled in the art will appreciate that different slant angles or radial orientation can be used in some of the openings or that their areas could be changed depending on the capabilities of the surface pumping equipment and maximum desired slurry velocities for erosion control.

While the openings 14 are shown as elongated and rectangular the openings can also be a series of ports in alignment with the inserts 16 shaped to still protect the inner passage 30 as shown in FIG. 4 and using a series of leading components 38 that enter each of the aligned holes in the housing 10. The leading components can extend to a taper such as 40 in the openings 14 or beyond. The taper 40 can be optionally omitted and the leading components 38 of the inserts 16 can extend as far or even beyond the outer surface 42 of the housing 10.

Those skilled in the art will now appreciate that the inserts 16 effectively protect the inside walls 22 by creating a passage 30 that has openings 44 that are located in the leading components 38 of the inserts 16. In this manner the wall of the housing 10 in the openings 14 is also protected especially where the extension of the leading components 38 is to or beyond the outer wall 42 of the housing 10. It eliminates the shortcomings of the discrete designs in U.S. Pat. Nos. 5,636,691 and 6,491,097 as discussed in the background of the invention.

The above description is illustrative of the preferred embodiment and many modifications may be made by those skilled in the art without departing from the invention whose scope is to be determined from the literal and equivalent scope of the claims below:

We claim:

1. A crossover completion tool for location above a screen assembly, comprising:

a tubular body having a passage therethrough and at least one outlet extending through a wall that defines said passage, a trailing location defined as being in said passage and a leading location, relative to said trailing location, is defined in said outlet;

said outlet providing initial access to a surrounding annulus outside said body and above the screen assembly for flow coming from said passage;

at least one unitary insert with at least one port extending from a trailing portion of said insert located within said passage and through a leading portion of said insert disposed outside said passage and in said outlet, said port in said unitary insert in fluid communication with said passage, said trailing portion being larger than said body outlet through which said leading portion is inserted such that said trailing portion spans over said body outlet and against said wall as said leading portion extends into said body outlet;

said insert is more resistant to erosion than said body to protect at least a portion of said body from slurry delivered into said passage.

2. The tool of claim 1, wherein:

said leading portion extends into said body outlet at least as far as an outer surface of said body.

3. The tool of claim 1, wherein:

said body outlet comprises a taper that enlarges said outlet in a direction toward an outer surface of said body;

said leading portion extends in said body outlet to said taper.

4. The tool of claim 1, wherein:

said leading portion has the same shape as said body outlet through said wall; and said leading portion extends to at least an outer surface of said body defined by said wall.

5. The tool of claim 1, wherein:

said at least one port on said insert comprises a plurality of ports extending through said trailing and leading portions.

6. The tool of claim 5, wherein:

at least one of said ports having a centerline that is not parallel to at least one other of said ports or at least one centerline is slanted with respect to the centerline of said body.

7. A crossover completion tool, comprising:

a tubular body having a passage and at least one outlet extending through a wall that defines said passage, a trailing location defined as being in said passage and a leading location, relative to said trailing location, is defined in said outlet;

at least one unitary insert with at least one port extending from a trailing portion of said insert located within said passage and through a leading portion of said insert disposed outside said passage and in said outlet, said trailing portion being larger than said body outlet through which said leading portion is inserted such that said trailing portion spans over said body outlet as said leading portion extends into said body outlet;

said insert is more resistant to erosion than said body to protect at least a portion of said body from slurry delivered into said passage;

said at least one outlet in said tubular body comprises a plurality of outlets and said at least one insert comprises a plurality of inserts so that each outlet is associated with a corresponding insert;

said trailing portions of said inserts contact each other in said body.

8. The tool of claim 7, wherein:

said body having an inside surface surrounding said outlets that are axially aligned in said body that is substantially overlapped by said trailing portions of said inserts.

9. The tool of claim 8, wherein:

said trailing portions of said inserts contact each other on at least one edge surface.

10. The tool of claim 7, wherein:

said leading portions extend into said body outlet at least as far as an outer surface of said body.

11. The tool of claim 7, wherein:

said body outlets comprise a taper that enlarges said outlet in a direction toward an outer surface of said body;

said leading portions extend in said body outlet to said taper.

12. The tool of claim 7, wherein:

said leading portions have the same shape as said body outlets through said wall; and said leading portions extend to at least an outer surface of said body defined by said wall.

13. The tool of claim 7, wherein:

said at least one port on each of said inserts comprises a plurality of ports extending through said trailing and leading portions.

14. The tool of claim 13, wherein:

at least one of said ports having a centerline that is not parallel to at least one other of said ports or at least one centerline is slanted with respect to the centerline of said body.

15. The tool of claim 7, wherein:

said inserts are fixedly or removably retained within said body.

16. The tool of claim 10, wherein:

said inserts are made from tungsten carbide and welded or brazed to said body for fixation.

17. A crossover completion tool, comprising:

a tubular body having a passage and at least one outlet extending through a wall that defines said passage;

at least one insert with at least one port extending from a trailing portion and through a leading portion thereof, said trailing portion being larger than said body outlet through which said leading portion is inserted such that said trailing portion spans over said body outlet as said leading portion extends into said body outlet;

said insert is more resistant to erosion than said body to protect at least a portion of said body from slurry delivered into said passage;

said at least one outlet in said tubular body comprises a plurality of outlets and said at least one insert comprises a plurality of inserts so that each outlet is associated with a corresponding insert;

said trailing portions of at least two said inserts contact each other in said body; said body having an inside surface surrounding said outlets in said body that is substantially overlapped by said trailing portions of said inserts;

said trailing portions engage each other in said passage of said body in an interference fit.

18. A crossover completion tool, comprising:

a tubular body having a passage and at least one outlet extending through a wall that defines said passage;

at least one insert with at least one port extending from a trailing portion and through a leading portion thereof, said trailing portion being larger than said body outlet through which said leading portion is inserted such that said trailing portion spans over said body outlet as said leading portion extends into said body outlet;

said insert is more resistant to erosion than said body to protect at least a portion of said body from slurry delivered into said passage;

said at least one outlet in said tubular body comprises a plurality of outlets and said at least one insert comprises a plurality of inserts so that each outlet is associated with a corresponding insert;

said trailing portions of at least two said inserts contact each other in said body; said body having an inside surface surrounding said outlets in said body that is substantially overlapped by said trailing portions of said inserts;

said trailing portions of said at least two inserts contact each other on at least one edge surface;

said trailing portions of said at least two inserts contact each other on more than one edge resulting in an overlap relationship between adjacent inserts.

19. A crossover completion tool for location above a screen assembly, comprising:

a tubular body having a passage therethrough and at least one outlet extending through a wall that defines said passage;

said outlet providing initial access to a surrounding annulus outside said body and above the screen assembly for flow coming from said passage;

at least one unitary insert with at least one port extending from a trailing portion of said insert located within said passage and through a leading portion of said insert disposed outside said passage and in said outlet, said port in said unitary insert in fluid communication with said passage, said trailing portion being larger than said body outlet through which said leading portion is inserted such that said trailing portion spans over said body outlet and against said wall as said leading portion extends into said body outlet;

said insert is more resistant to erosion than said body to protect at least a portion of said body from slurry delivered into said passage;

an outer tubular surrounding said port further comprising a hardened unitary sleeve, whereupon flow through said port directly impinges on said sleeve to protect said outer tubular from erosion from flow through said port.

20. A crossover completion tool, comprising:

a tubular body having a passage and at least one outlet extending through a wall that defines said passage;

at least one insert with at least one port extending from a trailing portion and through a leading portion thereof, said trailing portion being larger than said body outlet through which said leading portion is inserted such that said trailing portion spans over said body outlet as said leading portion extends into said body outlet;

said insert is more resistant to erosion than said body to protect at least a portion of said body from slurry delivered into said passage said at least one outlet in said tubular body comprises a plurality of outlets and said at least one insert comprises a plurality of inserts so that each outlet is associated with a corresponding insert;

said trailing portions of at least two said inserts contact each other in said body;

said inserts are fixedly or removably retained within said body;

said inserts are made from tungsten carbide and secured on opposed ends with overlapping retaining sleeves.

21. The tool of claim 20, wherein:

said retaining sleeves are removably or fixedly mounted to said body.

* * * * *